US008641838B2

(12) United States Patent
Kaneko et al.

(10) Patent No.: US 8,641,838 B2
(45) Date of Patent: Feb. 4, 2014

(54) COPPER ALLOY SHEET MATERIAL AND METHOD OF PRODUCING THE SAME

(75) Inventors: Hiroshi Kaneko, Tokyo (JP); Kiyoshige Hirose, Tokyo (JP); Koji Sato, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 437 days.

(21) Appl. No.: 12/958,109

(22) Filed: Dec. 1, 2010

(65) Prior Publication Data

US 2011/0073221 A1 Mar. 31, 2011

Related U.S. Application Data

(63) Continuation of application No. PCT/JP2009/060201, filed on Jun. 3, 2009.

(30) Foreign Application Priority Data

Jun. 3, 2008 (JP) ..... 2008-145707

(51) Int. Cl.

| | |
|---|---|
| ***C22C 9/00*** | (2006.01) |
| ***C22F 1/08*** | (2006.01) |
| ***H01B 5/02*** | (2006.01) |

(52) U.S. Cl.

USPC ..... 148/433; 148/434; 148/435; 148/553; 148/554; 148/682; 148/683; 420/485; 420/486; 420/487; 420/488; 420/490

(58) Field of Classification Search

USPC ..... 148/433, 434, 435, 553, 554, 682, 683; 420/485, 486, 487, 488, 490

See application file for complete search history.

(56) References Cited

U.S. PATENT DOCUMENTS

2005/0263218 A1 12/2005 Tanaka et al.

FOREIGN PATENT DOCUMENTS

| | | | |
|---|---|---|---|
| JP | 6-41660 | A | 2/1994 |
| JP | 2006-9137 | A | 1/2006 |
| JP | 2006-152392 | A | 6/2006 |
| JP | 2006-283059 | A | 10/2006 |
| JP | 2008-1937 | A | 1/2008 |
| JP | 2008-13836 | A | 1/2008 |

OTHER PUBLICATIONS

F.J. Humphreys et al., Recrystallization and Related Annealing Phenomena (Second Edition), Elsevier, (2004), pp. 70.

International Search Report, dated Sep. 1, 2009 and issued in PCT/JP2009/060201.

Kunio Ito, "Textures of aluminum alloy sheet", Journal of Japan Institute of Light Metals (JILM), vol. 43, No. 5, pp. 286, May 5, 1993.

Elsevier, "Recrystallization and Related Annealing Phenomena", XP-002675903, Dec. 31, 2004, p. V, VI, 70.

Extended European Search Report dated Jun. 4, 2012, for Application No. 09758368.6, PCT/JP2009060201.

*Primary Examiner* — Sikyin Ip

(74) *Attorney, Agent, or Firm* — Birch, Stewart, Kolasch & Birch, LLP

(57) ABSTRACT

A copper alloy sheet material, having a composition containing any one or both of Ni and Co in an amount of 0.5 to 5.0 mass % in total, and Si in an amount of 0.3 to 1.5 mass %, with the balance of copper and unavoidable impurities, wherein an area ratio of cube orientation {0 0 1} <1 0 0> is 5 to 50%, according to a crystal orientation analysis in EBSD measurement.

9 Claims, 1 Drawing Sheet

COPPER ALLOY SHEET MATERIAL AND METHOD OF PRODUCING THE SAME

CROSS REFERENCE TO RELATED APPLICATIONS

This application is a Continuation of copending PCT International Application No. PCT/JP2009/060201 filed on Jun. 3, 2009, and for which priority is claimed under 35 U.S.C. §120; and this application claims priority of Application No. 2008-145707 filed in Japan on Jun. 3, 2008 under 35 U.S.C. §119; the entire contents of all of the above applications is hereby incorporated by reference.

TECHNICAL FIELD

The present invention relates to a copper alloy sheet material that is applicable to lead frames, connectors, terminal materials, relays, switches, sockets, and the like for electrical or electronic equipments, and to a method of producing the same.

BACKGROUND ART

The properties required for a copper alloy material to be used for the uses in electrical or electronic equipments, such as lead frames, connectors, terminal materials, relays, switches, and sockets, include electrical conductivity, proof stress (yield stress), tensile strength, bending property, and stress relaxation resistance. In recent years, the demand for enhancing these properties is increased, concomitantly with the size reduction, weight reduction, enhancement of the performance, high density packaging, or the temperature rise in the use environment, of electrical or electronic equipments.

Conventionally, in addition to iron-based materials, copper-based materials, such as phosphor bronze, red brass, and brass, have also been widely used in general as the materials for electrical or electronic equipments. These alloys acquire enhanced strength through a combination of solid solution strengthening of Sn or Zn and work hardening based on cold working such as rolling or drawing. In this method, since the electrical conductivity is insufficient, and high strength is obtained by applying a high cold working ratio, the bending property or stress relaxation resistance is unsatisfactory.

There is available, as a strengthening method replacing this, precipitation strengthening by which a fine second phase is precipitated in the material. This strengthening method has advantages of enhancing the strength as well as simultaneously enhancing the electrical conductivity, and accordingly, this strengthening method has been implemented with many alloy systems. Among them, a Cu—Ni—Si-based alloy which is strengthened by finely precipitating compounds of Ni and Si in Cu (for example, C70250 as a CDA [Copper Development Association]-registered alloy) has an advantage of having high strengthening power, and is widely used. Furthermore, a Cu—Ni—Co—Si-based alloy or a Cu—Co—Si-based alloy, in which a part or the entirety of Ni is substituted with Co, has an advantage of having higher electrical conductivity than the Cu—Ni—Si system, and these alloys are being used in some applications. However, along with the recent downsizing of the parts to be used in electronic equipments or automobiles, the copper alloys to be used need to be such that a material having higher strength is subjected to bending at a smaller radius, and thus there is a strong demand for a copper alloy sheet material excellent in bending property. In order to obtain high strength in the conventional Cu—Ni—Co—Si system, potent work hardening may be obtained by increasing the working ratio in rolling, but this method deteriorates bending property as described above, and thus a good balance between high strength and satisfactory bending property cannot be achieved.

In regard to this demand for enhancement of bending property, some proposals are already made to solve the problem by controlling crystal orientation. It has been found in Patent Document 1 that in regard to a Cu—Ni—Si-based copper alloy, bending property is excellent when the copper alloy has a crystal orientation such as that the grain size and the X-ray diffraction intensities obtained from {3 1 1}, {2 2 0} and {2 0 0} planes satisfy certain conditions. Furthermore, it has been found in Patent Document 2 that in regard to a Cu—Ni—Si-based copper alloy, bending property is excellent when the copper alloy has a crystal orientation in which the X-ray diffraction intensities obtained from {2 0 0} plane and {2 2 0} plane satisfy certain conditions. It has also been found in Patent Document 3 that in regard to a Cu—Ni—Si-based copper alloy, excellent bending property is obtained by controlling the ratio of the cube orientation {1 0 0} <0 0 1>.

Patent Document 1: JP-A-2006-009137 ("JP-A" means unexamined published Japanese patent application)

Patent Document 2: JP-A-2008-013836

Patent Document 3: JP-A-2006-283059

DISCLOSURE OF INVENTION

Technical Problem

However, according to the inventions described in Patent Document 1 or Patent Document 2, an analysis of the limited accumulation of particular crystal planes, such as {2 0 0}, {2 2 0} and {3 1 1} planes, is nothing more than a very small portion of data in the extensive distribution of crystal planes. In addition to the above, the patent documents merely make measurements of the crystal planes in the planar direction (sheet's plane direction) only, and do not disclose which crystal planes are facing in the rolling direction or the transverse direction. Therefore, in order to control a texture excellent in bending property based on the descriptions of the inventions described in Patent Document 1 or Patent Document 2, the control may be achieved incompletely, and thus it is insufficient. Furthermore, in the invention described in Patent Document 3, the control of the crystal orientation is realized by a reduction of the rolling working ratio after the solution heat treatment.

On the other hand, along with the recent further downsizing, enhancement of the performance, high density packaging, and the like of copper alloy materials for electrical or electronic equipments, the copper alloy materials for electrical or electronic equipments have been required to have a bending property higher than the bending property assumed in the inventions described in the patent documents mentioned above.

Under such circumstances, the present invention is contemplated for providing a copper alloy sheet material which is excellent in bending property and mechanical strength, and which is favorable for lead frames, connectors, terminal materials, and the like for electrical or electronic equipments, and connectors, terminal materials, relays, switches, and the like to be mounted on automobile vehicles, or other uses.

Solution to Problem

The inventors of the present invention have conducted studies on copper alloys favorable for the applications in electrical and electronic parts, and have found that, in order to enhance the bending property, strength, electrical conductivity, and stress relaxation properties remarkably in Cu—Ni—Si-based, Cu—Ni—Co—Si-based, or Cu—Co—Si-based copper alloys, there are correlations between the bending property, and the ratio of cube orientation accumulation, and further the ratio of S-orientation. Thus, after having keenly studies, the present invention is attained. In addition, the inventors have made the present invention on an additional element having a function of enhancing the strength or stress relaxation properties for the present alloy system without impairing the electrical conductivity or bending property. Furthermore, the inventors invented a production method for realizing the crystal orientation such as described above.

According to the present invention, there is provided the following means:

(1) A copper alloy sheet material, having a composition comprising any one or both of Ni and Co in an amount of 0.5 to 5.0 mass % in total, and Si in an amount of 0.3 to 1.5 mass %, with the balance of copper and unavoidable impurities, wherein an area ratio of cube orientation {0 0 1} <1 0 0> is 5 to 50%, according to a crystal orientation analysis in EBSD measurement;

(2) A copper alloy sheet material, having a composition comprising any one or both of Ni and Co in an amount of 0.5 to 5.0 mass % in total, and Si in an amount of 0.3 to 1.5 mass %, with the balance of copper and unavoidable impurities, wherein an area ratio of cube orientation {0 0 1} <1 0 0> is 5 to 50%, and an area ratio of S orientation {3 2 1} <3 4 6> is 5 to 40%, according to a crystal orientation analysis in EBSD measurement;

(3) The copper alloy sheet material according to item (1) or (2), wherein the copper alloy contains at least one selected from the group consisting of Sn, Zn, Ag, Mn, B, P, Mg, Cr, Fe, Ti, Zr, and Hf, in an amount of 0.005 to 1.0 mass % in total;

(4) The copper alloy sheet material according to any one of items (1) to (3), wherein an average grain size of grains of cube orientation {0 0 1} <1 0 0> is 20 μm or less;

(5) A method of producing a copper alloy sheet material according to any one of items (1) to (4), comprising the steps of treatments and workings of a copper alloy material that serves as a raw material for the copper alloy sheet material: casting [step 1], homogenization heat treatment [step 2], hot working [step 3], water cooling [step 4], face milling [step 5], cold rolling [step 6], heat treatment [step 7], cold rolling [step 8], intermediate solution heat treatment [step 9], cold rolling [step 10], aging precipitation heat treatment [step 11], finish cold rolling [step 12], and temper annealing [step 13], in this sequence, wherein the heat treatment [step 7] is conducted at a temperature of 400 to 800° C. for a time period of 5 seconds to 20 hours, wherein the cold rolling [step 8] is conducted at a working ratio of 50% or less, and wherein the sum of a working ratio R1(%) in the cold rolling [step 10] and a working ratio R2(%) in the finish cold rolling [step 12] is 5 to 65%;

(6) The method of producing a copper alloy sheet material according to item (5), wherein the aging precipitation heat treatment [step 11] is carried out as the final step, wherein the heat treatment [step 7] is conducted at the temperature of 400 to 800° C. for the time period of 5 seconds to 20 hours, wherein the cold rolling [step 8] is conducted at the working ratio of 50% or less, and wherein the working ratio R1(%) in the cold rolling [step 10] is 5 to 65%;

(7) The method of producing a copper alloy sheet material according to item (5), wherein the aging precipitation heat treatment [step 11] is carried out as a subsequent step of the intermediate solution heat treatment [step 9], wherein the heat treatment [step 7] is conducted at the temperature of 400 to 800° C. for the time period of 5 seconds to 20 hours, wherein the cold rolling [step 8] is conducted at the working ratio of 50% or less, and wherein the working ratio R2(%) in the finish cold rolling [step 12] is 5 to 65%;

(8) The method of producing a copper alloy sheet material according to item (5), wherein the face milling [step 5] is carried out as a subsequent step of the hot working [step 3], wherein the heat treatment [step 7] is conducted at the temperature of 400 to 800° C. for the time period of 5 seconds to 20 hours, wherein the cold rolling [step 8] is conducted at the working ratio of 50% or less, and wherein the sum of the working ratio R1(%) in the cold rolling [step 10] and the working ratio R2(%) in the finish cold rolling [step 12] is 5 to 65%; and (9) The method of producing a copper alloy sheet material according to item (5), wherein the hot working [step 3] is carried out as a subsequent step of the casting [step 1], wherein the heat treatment [step 7] is conducted at the temperature of 400 to 800° C. for the time period of 5 seconds to 20 hours, wherein the cold rolling [step 8] is conducted at the working ratio of 50% or less, and wherein the sum of the working ratio R1(%) in the cold rolling [step 10] and the working ratio R2(%) in the finish cold rolling [step 12] is 5 to 65%.

Advantageous Effects of Invention

According to the present invention, a copper alloy sheet material can be provided, which is excellent in properties of mechanical strength, bending property, electrical conductivity, and stress relaxation resistance, and which is preferably favorable for the use in electrical or electronic equipments.

Other and further features and advantages of the invention will appear more fully from the following description, appropriately referring to the accompanying drawings.

EXPLANATION OF REFERENCE NUMERALS

Figure 1:
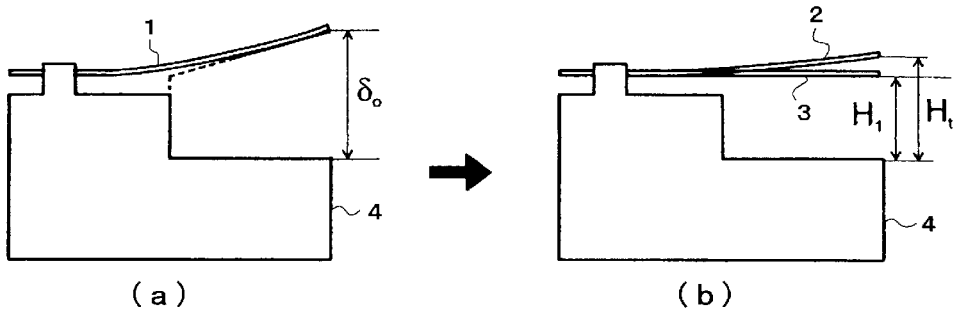
FIG. 1 is explanatory diagrams for the method of testing the stress relaxation properties, in which FIG. 1(*a*) shows the state before heat treatment, and FIG. 1(*b*) shows the state after the heat treatment.

| | |
|---|---|
| 1 | Test specimen with an initial stress applied thereon |
| 2 | Test specimen after removing the load |
| 3 | Test specimen without any stress applied thereon |
| 4 | Test bench |
| 11 | Test specimen (after removing the load) |
| 12 | Test jig |
| 13 | Reference plane |
| 14 | Bolt for deflection loading |
| 15 | Test specimen (with deflection loading applied) |

BEST MODE FOR CARRYING OUT THE INVENTION

Preferable embodiments of the copper alloy sheet material of the present invention will be described in detail. Herein, the term "sheet material" according to the present invention is intended to also include a "bar material".

In the present invention, when the respective amounts of addition of nickel (Ni), cobalt (Co), and silicon (Si) that are added to copper (Cu) are brought under control, Ni—Si, Co—Si, and/or Ni—Co—Si compounds can be precipitated, to thereby enhance the mechanical strength of the resultant copper alloy. The copper alloy in the present invention contains Ni and Co in an amount of 0.5 to 5.0 mass %, preferably 1.0 to 4.0 mass %, and more preferably 1.5 to 3.5 mass %, in total. The copper alloy may contain only any one of Ni and Co, and may contain both of Ni and Co. The content of Ni is preferably 0.5 to 4.0 mass %, and more preferably 1.0 to 4.0 mass %, and the content of Co is preferably 0.5 to 2.0 mass %, and more preferably 0.6 to 1.7 mass %. Furthermore, the copper alloy in the present invention contains Si in an amount of 0.3 to 1.5 mass %, preferably 0.4 to 1.2 mass %, and more preferably 0.5 to 1.0 mass %. If the amounts of addition of Ni, Co and Si are too large, the electrical conductivity is decreased, and if the amount of addition is too small, the strength is insufficient.

In order to improve the bending property of copper alloy sheet materials, the inventors of the present invention have conducted an investigation on the cause of cracks occurring at the bent portion. As a result, the inventors have found that plastic deformation develops locally, thereby forming a shear deformation zone, and generation and connection of micro-voids occur as a result of localized work hardening, so that the forming limit is reached, which is causative of the cracks. The inventors have found, as a countermeasure, that it is effective to increase the ratio of a crystal orientation at which work hardening is difficult to occur upon bending deformation. That is, the inventors invented that when the area ratio of cube orientation {0 0 1} <1 0 0> is 5% to 50%, satisfactory bending property is exhibited. If the area ratio of cube orientation is smaller than 5%, the effects are insufficient. On the other hand, if the area ratio is increased to be greater than 50%, the cold rolling following a recrystallization treatment must be conducted at a low working ratio, and the strength is conspicuously deteriorated, which is not preferable. Moreover, if the area ratio is higher than 50%, the stress relaxation properties are also deteriorated, which is not preferable. The area ratio is preferably in the range of 7 to 47%, and more preferably 10 to 45%.

Herein, the method of indicating the crystal orientation in the present specification is such that a Cartesian coordinate system is employed, representing the rolling direction (RD) of the material in the X-axis, the transverse direction (TD) in the Y-axis, and the direction normal to the rolling direction (ND) in the Z-axis, various regions in the material are indicated in the form of (h k l) [u v w], using the index (h k l) of the crystal plane that is perpendicular to the Z-axis (parallel to the rolled plane) and the index [u v w] in the crystal direction parallel to the X-axis. Furthermore, the orientation that is equivalent based on the symmetry of the cubic crystal of a copper alloy is indicated as {h k l} <u v w>, using parenthesis symbols representing families, such as in (1 3 2) [6 −4 3], and (2 3 1) [3 −4 6]. The cube orientation is represented by the index of {0 0 1} <1 0 0>, and the S-orientation is represented by the index of {3 2 1} <3 4 6>.

Furthermore, in addition to the cube orientation in the above range, it is preferable that the S-orientation {3 2 1} <3 4 6> be present in the range of 5 to 40%, since it is effective in the improvement of bending property. The area ratio of the S-orientation {3 2 1} <3 4 6> is more preferably 7% to 37%, and further preferably 10% to 35%. In addition to the cube orientation and the S-orientation, there occur Copper orientation {1 2 1} <1 −1 1>, D orientation {4 11 4} <11 −8 11>, Brass orientation {1 1 0} <1 −1 2>, Goss orientation {1 1 0} <0 0 1>, R1 orientation {2 3 6} <3 8 5>, and the like. However, when the cube orientation is present at an area ratio of 5% to 50%, and the S-orientation is present at an area ratio of 5% to 40%, the copper alloy is allowed to include any of these orientation components.

The analysis of the crystal orientation in the present invention is conducted using the EBSD method. The EBSD method, which stands for Electron Back-Scatter Diffraction, is a technique of crystal orientation analysis using reflected electron Kikuchi-line diffraction that occurs when a sample is irradiated with an electron beam under a scanning electron microscope (SEM). A sample area measured 0.1 μm on each of the four sides and containing 200 or more grains, was subjected to an analysis of the orientation, by scanning in a stepwise manner at an interval of 0.5 μm or the like. The measurement area and the scanning step were adjusted based on the size of grains of the sample. The area ratio of the respective orientation is the ratio of the area of grains having the orientations within ±10° from the ideal orientation of the cube orientation {0 0 1} <1 0 0> or the S-orientation {3 2 1} <3 4 6>, to the sum total of the measured areas of the whole grains. The data obtained from the orientation analysis based on EBSD includes the orientation data to a depth of several tens nanometers, through which the electron beam penetrates into the sample. However, since the depth is sufficiently small as compared with the width to be measured, the data is described in terms of area ratio in the present specification. In addition, the measurement was conducted from the surface layer portion of the sheet.

Since EBSD measurement is used for the analysis of crystal orientation, this is largely different from the measurement of the accumulation of particular atomic plane(s) against the plane direction according to the conventional X-ray diffraction method, and complete three-dimensional crystal orientation data is obtained with high resolution power. Therefore, it is possible to obtain completely novel data on the crystal orientation that governs bending property.

Next, the effects of a subsidiary additional element(s) to the alloy in the present invention will be described. Preferable examples of the subsidiary additional element include Sn, Zn, Ag, Mn, B, P, Mg, Cr, Fe, Ti, Zr, and Hf. If these elements are contained in a total amount of more than 1 mass %, these elements cause an adverse affection of decreasing the electrical conductivity, which is not preferable. When the subsidiary additional element is added, in order to sufficiently utilize the effects of adding the same and to prevent a decrease in the electrical conductivity, the subsidiary additional element needs to be added in a total amount of 0.005 to 1.0 mass %, preferably 0.01 mass % to 0.9 mass %, and more preferably 0.03 mass % to 0.8 mass %. The effects of addition of the respective elements will be described below.

Mg, Sn, and Zn improve the stress relaxation resistance when added to Cu—Ni—Si-based, Cu—Ni—Co—Si-based, and Cu—Co—Si-based copper alloys. When these elements are added together, as compared with the case where any one of them is added, the stress relaxation resistance is further improved by synergistic effects. Furthermore, an effect of remarkably improving solder brittleness is obtained.

Mn, Ag, B, and P, when added, improve hot workability, and at the same time, enhance the strength.

Cr, Fe, Ti, Zr, and Hf finely precipitate in the form of compounds with Ni, Co, or Si, which are main elements to be added, or in the form of simple elements, to contribute to precipitation hardening. Furthermore, these elements precipitate in the form of compounds having a size of 50 to 500 nm, and suppress grain growth, thereby having an effect of making the grain size fine and making the bending property satisfactory.

Furthermore, the average grain size of the grains having the cube orientation is preferably 20 μm or less, more preferably 17 μm or less, and further preferably 15 to 3 μm. When the average grain size of the grains having the cube orientation is controlled to the range described above, an effect is obtained to reduce wrinkles that may occur at the surface of the bent portion, and further excellent bending property is realized. The average grain size of the grains having the cube orientation in the present invention is a value obtained by measuring the grain size by extracting only those areas showing the cube orientation in the orientation analysis in the EBSD method, and calculating the average value. In this case, {2 2 1} <2 1 2> orientation, which is the twin orientation of the cube orientation that is adjacent to the cube orientation, is a value obtained by performing an analysis while the twin orientation is considered to be included in the cube orientation.

Next, preferable conditions for the production of the copper alloy sheet material of the present invention will be described. An example of the conventional method of producing a precipitation-type copper alloy is to conduct: a casting [step 1] of a copper alloy material to obtain an ingot, subjecting this ingot to a homogenization heat treatment [step 2], a hot working [step 3], such as hot rolling, a water cooling [step 4], a face milling [step 5], and a cold rolling [step 6], in this sequence, to give a thin sheet, and then to subject the thin sheet to an intermediate solution heat treatment [step 9] at a temperature in the rang of 700° C. to 1,020° C., to thereby form a solid solution of solute atoms again, followed by an aging precipitation heat treatment [step 11], and a finish cold rolling [step 12], to satisfy the required strength. In these series of steps, the texture of the material is approximately determined by the recrystallization that occurs upon the intermediate solution heat treatment, and is finally determined by the rotation of orientation that occurs upon the finish rolling.

In a preferable embodiment of the method of producing a copper alloy sheet material of the present invention, before this intermediate solution heat treatment [step 9], by adding a heat treatment [step 7] conducted at a temperature of 400° C. to 800° C. for a time period of 5 seconds to 20 hours, and, further, a cold rolling [step 8] at a working ratio of 50% or less, the area ratio of the cube orientation is increased in the recrystallized texture obtained by the intermediate solution heat treatment [step 9]. Herein, the heat treatment [step 7] is conducted at a lower temperature as compared with the intermediate solution heat treatment [step 9]. Herein, in the heat treatment [step 7] and the intermediate solution heat treatment [step 9], it is preferable to perform the heat treatments for a longer time period in the case of low temperature, and to perform the heat treatments for a shorter time period in the case of high temperature.

If the treatment temperature in the heat treatment [step 7] is lower than 400° C., there is a strong tendency that recrystallization does not occur, which is not preferable. If the treatment temperature is higher than 800° C., there is a strong tendency that the grain size becomes coarse, which is not preferable. Thus, the treatment temperature of the heat treatment [step 7] is preferably 450 to 750° C., and more preferably 500 to 700° C. Furthermore, the treatment time of the heat treatment [step 7] is preferably 1 minute to 10 hours, and more preferably 30 minutes to 4 hours. In the relationship between temperature and time period of the heat treatment [step 7], in the case of the temperature of 450 to 750° C., the treatment time is preferably 1 minute to 10 hours (a longer time period in the case of low temperature, and a shorter time period in the case of high temperature), and in the case of the treatment temperature of 500 to 700° C., the treatment time is preferably 30 minutes to 4 hours (a longer time period in the case of low temperature, and a shorter time period in the case of high temperature). The working ratio of the cold rolling [step 8] is preferably 45% or less, and more preferably 5 to 40%. Furthermore, the treatment temperature of the intermediate solution heat treatment [step 9] is preferably 750 to 1,020° C., and the treatment time is preferably 5 seconds to 1 hour.

Furthermore, after the intermediate solution heat treatment [step 9], a cold rolling [step 10], an aging precipitation heat treatment [step 11], a finish cold rolling [step 12], and a temper annealing [step 13] are carried out. Herein, it is preferable to carry out the cold rolling [step 10] and the finish cold rolling [step 12] at a sum of working ratios R1 and R2, respectively, of 5% to 65%. At a working ratio of 5% or less, the amount of work hardening is small, and the strength is insufficient. At a working ratio of 65% or more, the cube orientation region produced by the intermediate solution heat treatment, rotates to another orientation, such as Copper orientation, D-orientation, S-orientation, or Brass orientation, as a result of rolling, and the area ratio of the cube orientation is lowered, which is not preferable. More preferably, the sum of the working ratios R1 and R2 is 10% to 50%. The calculation of the working ratios R1 and R2 was carried out as follows.

$$R1(\%)=(t[9]-t[10])/t[9]\times 100$$

$$R2(\%)=(t[10]-t[12])/t[10]\times 100$$

In the formulas, t[9], t[10], and t[12] represent the respective sheet thicknesses after the intermediate solution heat treatment [step 9], after the cold rolling [step 10], and after the finish cold rolling [step 12].

Furthermore, the parts other than the parts mentioned above can be carried out in the same manner as in the steps of the conventional production methods.

It is preferable to produce the copper alloy sheet material of the present invention by the production method of the embodiment described above. However, if a copper alloy sheet material in which the area ratio of the cube orientation {0 0 1} <1 0 0> is 5% to 50% in the crystal orientation analysis in the EBSD measurement, the method is not necessarily restricted to have all of the [step 1] to [step 13] in the sequence described above, and the production may also be carried out by, for example, methods that are included in the method described above, while using the combinations of steps among the [step 1] to [step 13] such as shown below.

a. A method of subjecting the copper alloy material that is used as the raw material of the copper alloy sheet material, to the treatments and workings of: the casting [step 1], the homogenization heat treatment [step 2], the hot working [step 3], the water cooling [step 4], the face milling [step 5], the cold rolling [step 6], the heat treatment [step 7], the cold rolling [step 8], the intermediate solution heat treatment [step 9], the cold rolling [step 10], and the aging precipitation heat treatment [step 11], in this sequence, wherein the heat treatment [step 7] is conducted at a temperature of 400 to 800° C. for a time period in the range of 5 seconds to 20 hours, wherein the cold rolling [step 8] is conducted at a working ratio of 50% or less, and wherein the cold rolling [step 10] is conducted at the working ratio R1(%) of 5% to 65%. This method is applicable when the demand for mechanical strength is not very high.

b. A method of subjecting the copper alloy material that is used as the raw material of the copper alloy sheet material, to the treatments and workings of: the casting [step 1], the homogenization heat treatment [step 2], the hot working [step 3], the water cooling [step 4], the face milling [step 5], the cold rolling [step 6], the heat treatment [step 7], the cold rolling [step 8], the intermediate solution heat treatment [step 9], the aging precipitation heat treatment [step 11], the finish cold rolling [step 12], and the temper annealing [step 13], in this sequence, wherein the heat treatment [step 7] is conducted at a temperature of 400 to 800° C. for a time period in the range of 5 seconds to 20 hours, wherein the cold rolling [step 8] is conducted at a working ratio of 50% or less, and wherein the working ratio R2(%) in the finish cold rolling [step 12] is 5 to 65%. This method is applicable when the demand for mechanical strength is not very high, similarly to the case of the method a above.

c. A method of subjecting the copper alloy material that is used as the raw material of the copper alloy sheet material, to the treatments and workings of: the casting [step 1], the homogenization heat treatment [step 2], the hot working [step 3], the face milling [step 5], the cold rolling [step 6], the heat treatment [step 7], the cold rolling [step 8], the intermediate solution heat treatment [step 9], the cold rolling [step 10], the aging precipitation heat treatment [step 11], the finish cold rolling [step 12], and the temper annealing [step 13], in this sequence, wherein the heat treatment [step 7] is conducted at a temperature of 400 to 800° C. for a time period in the range of 5 seconds to 20 hours, wherein the cold rolling [step 8] is conducted at a working ratio of 50% or less, and wherein the sum of the working ratio R1(%) in the cold rolling [step 10] and the working ratio R2(%) in the finish cold rolling [step 12] is 5% to 65%. This method is applicable when the temperature at the time of completion of the hot working [step 3] is a temperature that does not require the water cooling [step 4] (for example, 550° C. or lower).

d. A method of subjecting the copper alloy material that is used as the raw material of the copper alloy sheet material, to the treatments and workings of: the casting [step 1], the hot working [step 3], the water cooling [step 4], the face milling [step 5], the cold rolling [step 6], the heat treatment [step 7], the cold rolling [step 8], the intermediate solution heat treatment [step 9], the cold rolling [step 10], the aging precipitation heat treatment [step 11], the finish cold rolling [step 12], and the temper annealing [step 13], in this sequence, wherein the heat treatment [step 7] is conducted at a temperature of 400 to 800° C. for a time period in the range of 5 seconds to 20 hours, wherein the cold rolling [step 8] is conducted at a working ratio of 50% or less, and wherein the sum of the working ratio R1(%) in the cold rolling [step 10] and the working ratio R2(%) in the finish cold rolling [step 12] is 5% to 65%. This method is applicable when the state of segregation in the casting [step 1] is negligible, or when the state of segregation does not have any influence on the copper alloy material and the electrical or electronic parts produced by working the copper alloy material.

When meeting the conditions described above, the copper alloy sheet material of the present invention can satisfy the properties required, for example, for copper alloy sheet materials for connectors. In particular, the present invention can realize satisfactory properties of: a 0.2% proof stress of 600 MPa or more, a bending property in terms of a value of 1 or less which is obtained by dividing the minimum bending radius capable of bending without any cracks in a 90° W-bending test by the sheet thickness, an electrical conductivity of 35% IACS or more, and a stress relaxation resistance of 30% or less.

EXAMPLES

The present invention will be described in more detail based on examples given below, but the invention is not meant to be limited by these.

Example 1

As shown with the respective composition in the column for alloy elements in Tables 1 and 2, an alloy containing at least one or both of Ni and Co in an amount of 0.5 to 5.0 mass % in total, and Si in an amount of 0.3 to 1.5 mass %, and blending other additional elements each in an appropriate content, with the balance being composed of Cu and unavoidable impurities, was melted in a high frequency melting furnace. The resultant respective molten alloy was subjected to the casting [step 1] at a cooling speed of 0.1 to 100° C./second, to obtain an ingot. The resultant respective ingot was subjected to the homogenization heat treatment [step 2] at a temperature of 900 to 1,020° C. for 3 minutes to 10 hours, to the hot working [step 3] (the initiation temperature in this example being 900° C.), and then to a water quenching (corresponding to the water cooling [step 4]), followed by the face milling [step 5] to remove oxidized scales. Then, the resultant respective worked and heat-treated alloy sheet was subjected to the cold rolling [step 6] at a working ratio of from 80% to 99.8%, the heat treatment [step 7] at a temperature of 400° C. to 800° C. for a time period in the range of 5 seconds to 20 hours, the cold rolling [step 8] at a working ratio of 2% to 50%, the intermediate solution heat treatment [step 9] at a temperature of 750° C. to 1,020° C. for a time period in the range of 5 seconds to 1 hour, the cold rolling [step 10] at a working ratio of 3% to 35%, the aging precipitation heat treatment [step 11] at a temperature of 400° C. to 700° C. for 5 minutes to 10 hours, the finish cold rolling [step 12] at a working ratio of 3% to 25%, and the temper annealing [step 13] at a temperature of 200° C. to 600° C. for 5 seconds to 10 hours. Thus, test specimens of Examples 1-1 to 1-19 and Comparative Examples 1-1 to 1-8 were produced. After the respective heat treatment or rolling above, acid washing or surface polishing was carried out according to the state of oxidation or roughness of the material surface, and correction using a tension leveler was carried out according to the shape.

The appropriate temperature and time period for the homogenization heat treatment [step 2] vary with the concentration of the alloy and the cooling speed at the time of casting. For this reason, a temperature and a time period were employed, by which a dendritic texture observed in the microtexture of the ingot as a result of segregation of solute elements, almost disappeared after the homogenization heat treatment.

The hot working [step 3] was carried out, for the material obtained after the homogenization heat treatment, by a usual plastic working (rolling, extrusion, drawing, or the like). The temperature at the time of initiation of the hot working was set in the range of 600 to 1,000° C. so as to prevent occurrence of breakage of the material.

Furthermore, in the respective steps of the homogenization heat treatment [step 2], the heat treatment [step 7], the intermediate solution heat treatment [step 9], the aging precipitation heat treatment [step 11], and the temper annealing [step 13], it is preferable to perform the heat treatment for a longer time period in the case of low temperature, and to perform the heat treatment for a shorter time period in the case of high temperature. When the heat treatment is performed for a shorter time period at low temperature, there is a tendency that the effect of the heat treatment is hardly exhibited. When the heat treatment is performed for a longer time period at high temperature, an adverse affect of a conspicuous lowering of the mechanical strength tends to occur.

Please note that Comparative Examples 1-5 and 1-6 in the tables shown below were produced without performing the heat treatment [step 7] and the cold rolling [step 8] among the steps mentioned in the above. In Comparative Examples 1-7 and 1-8, the cold rolling [step 10] among the steps mentioned in the above was not carried out, and the finish rolling [step 12] was conducted at a working ratio of 3%.

The thus-obtained test specimens were subjected to examination of the properties as described below. Herein, the thickness of the respective test specimen was set at 0.15 mm. The results of Examples according to the present invention are shown in Table 1, and those of Comparative Examples are shown in Table 2.

a. Area Ratios of Cube Orientation and S-Orientation:

The measurement was conducted by the EBSD method under the conditions of a measurement area of 0.04 to 4 $mm^2$ and a scan step of 0.5 to 1 μm. The area to be measured was adjusted on the basis of the condition of inclusion of 200 or more grains. The scan step was adjusted according to the grain size, such that when the average grain size was 15 μm or less, scanning was performed at a step of 0.5 μm, and when the average grain size was 30 μm or less, scanning was performed at a step of 1 μm. The electron beam was generated by using thermoelectrons from a W filament of a scanning electron microscope as the source of generation.

b. Bending Property:

Samples to be tested with width 10 mm and length 35 mm were cut perpendicularly to the rolling direction from the test specimens, respectively. The respective sample was subjected to W bending such that the axis of bending was perpendicular to the rolling direction, which is designated as GW (Good Way), and separately subjected to W bending such that the axis of bending was parallel to the rolling direction, which is designated as BW (Bad Way). The thus-bent portions were observed under an optical microscope at a magnification of 50 times, to observe occurrence of cracks if any. According to the results, a sample which did not have any crack occurred at the bent portion was judged to be "good" (o), and a sample which had cracks occurred was judged to be "poor" (x). The bending angle at the respective bent portion was set at 90°, and the inner radius of the respective bent portion was set at 0.15 mm.

c. 0.2% Proof Stress [YS]:

Three test specimens that were cut out from the direction parallel to the rolling direction, according to JIS Z2201-13B, were measured according to JIS Z2241, and the 0.2% proof stress (yield strength) was shown as an average value of the results.

d. Electrical Conductivity [EC]:

The electrical conductivity (% IACS) was calculated by using the four-terminal method to measure the specific resistance of the material in a thermostat bath that was maintained at 20° C. (±0.5° C.). The spacing between terminals was 100 mm.

e. Stress Relaxation Ratio [SR]:

The stress relaxation ratio was measured, according to the former Electronic Materials Manufacturer's Association of Japan Standard (EMAS-3003) under conditions of 150° C. for 1,000 hours, as shown in the below. An initial stress that was 80% of the yield strength (proof stress) was applied, by the cantilever method.

FIG. 1 is a drawing explaining the method for testing the stress relaxation property, in which FIG. 1(*a*) shows the state before heat treatment, and FIG. 1(*b*) shows the state after the heat treatment. As shown in FIG. 1(*a*), the position of a test specimen 1 when an initial stress of 80% of the proof stress was applied to the test specimen 1 cantilevered on a test bench 4, is defined as the distance $\delta_0$ from the reference position. This test specimen was kept in a thermostat bath at 150° C. for 1,000 hours. The position of the test specimen 2 after removing the load, is defined as the distance $H_t$ from the reference position, as shown in FIG. 1(*b*). The reference numeral 3 denotes the test specimen to which no stress was applied, and the position of the test specimen 3 is defined as the distance $H_1$ from the reference position. Based on the relationships between those positions, the stress relaxation ratio (%) was calculated as $(H_t-H_1)/\delta_0\times100$.

The following methods are also applicable as similar test methods: "JCBA T309: 2001 (provisional); Stress relaxation testing method based on bending of copper and copper alloy thin sheets and rods", which is in the technology standard proposals, published by the Japan Copper and Brass Association (JCBA); "ASTM E328; Standard Test Methods for Stress Relaxation Tests for Materials and Structures", which is a test method, published by the American Society for Testing and Materials (ASTM); and the like.

Figure 2:
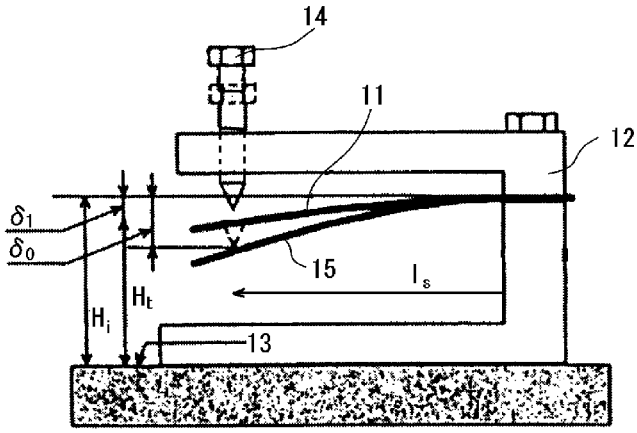
FIG. 2 is an explanatory diagram for the method of testing the stress relaxations based on JCBA T309:2001 (provisional).

FIG. 2 is an explanatory diagram for the stress relaxation testing method using a test jig for deflection displacement loading of a lower deflection-type and cantilever screw-type, based on the above-mentioned JCBA T309:2001 (provisional). Since the principle of this testing method is similar to that of the testing method using the test bench of FIG. 1, an almost same value of stress relaxation ratio is obtained as well.

In this testing method, first, a test specimen 11 was mounted on a test jig (testing apparatus) 12, and the test specimen was subjected to a predetermined displacement at room temperature, followed by maintaining for 30 seconds. After removing the load, the bottom face of the test jig 12 was designated as a reference plane 13, and the distance between this plane 13 and the point of deflection loading of the test specimen 11, was measured as $H_i$. After a lapse of the predetermined time period, the test jig 12 was taken out at normal temperature from a thermostat bath or heating furnace, and the bolt 14 for deflection loading is made loose to remove the load. The test specimen 11 was cooled to normal temperature, and then the distance $H_t$ between the reference plane 13 and the point of deflection loading of the test specimen 11 was measured. After the measurement, a deflection displacement was applied again. In the figure, reference numeral 11 represents the test specimen after removing the load, and reference numeral 15 represents the test specimen with deflection loading. The permanent deflection displacement $\delta_t$ is determined by the following formula.

$$\delta_t=H_i-H_t$$

From this relationship, the stress relaxation ratio (%) is calculated by: $\delta_t/\delta_0\times100$.

Herein, $\delta_0$ represents the initial deflection displacement of the test specimen required to obtain a predetermined stress, and is calculated by the following formula:

$$\delta_0=\sigma|_s^2/1.5Eh$$

wherein σ is the maximum surface stress of test specimen ($N/mm^2$), h is the sheet thickness (mm), E is a coefficient of deflection ($N/mm^2$), and $I_s$ is a span length (mm).

f. Average Grain Size of Grains of Cube Orientation [Gs of Cube Grains]:

Orientation regions within ±10° from the cube orientation were extracted in the orientation analysis based on EBSD, the grain sizes of 20 or more grains were measured, and the average was calculated. In this case, {2 2 1} <2 1 2> orientation that is adjacent to and inside of the grains of the cube orientation, is a twin orientation of the cube orientation, and it was interpreted to be included in the cube orientation.

TABLE 1

| Identification number*1 | Alloy elements Ni mass % | Co mass % | Si mass % | Area*2 % cube*3 % | S*4 % | Bending property*5 GW | BW | YS MPa | EC % IACS | SR % | GS*6 μm |
|---|---|---|---|---|---|---|---|---|---|---|---|
| Ex 1-1 | 0.50 | 1.00 | 0.36 | 45 | 15 | ○ | ○ | 652 | 54.2 | 25.1 | 9.5 |
| Ex 1-2 | 1.00 | 0.50 | 0.38 | 38 | 22 | ○ | ○ | 710 | 51.3 | 24.5 | 8.9 |
| Ex 1-3 | — | 0.80 | 0.45 | 25 | 32 | ○ | ○ | 682 | 53.1 | 24.6 | 7.8 |
| Ex 1-4 | 0.50 | 1.50 | 0.35 | 10 | 20 | ○ | ○ | 715 | 52.0 | 25.2 | 8.2 |
| Ex 1-5 | 0.80 | 1.20 | 0.42 | 37 | 12 | ○ | ○ | 708 | 51.0 | 23.4 | 8.6 |
| Ex 1-6 | 1.00 | 1.00 | 0.48 | 24 | 15 | ○ | ○ | 729 | 49.9 | 24.6 | 9.3 |
| Ex 1-7 | 2.32 | — | 0.65 | 48 | 19 | ○ | ○ | 704 | 40.5 | 26.2 | 11.5 |
| Ex 1-8 | 0.90 | 1.70 | 0.61 | 35 | 36 | ○ | ○ | 830 | 46.5 | 25.0 | 12.0 |
| Ex 1-9 | 1.10 | 1.50 | 0.55 | 12 | 21 | ○ | ○ | 825 | 45.8 | 25.4 | 9.7 |
| Ex 1-10 | — | 1.38 | 0.38 | 18 | 34 | ○ | ○ | 790 | 44.7 | 25.0 | 8.5 |
| Ex 1-11 | 1.35 | 1.15 | 0.61 | 22 | 32 | ○ | ○ | 730 | 53.0 | 25.3 | 12.3 |
| Ex 1-12 | 1.35 | 1.15 | 0.61 | 14 | 31 | ○ | ○ | 862 | 43.0 | 25.3 | 11.0 |
| Ex 1-13 | 1.5 | 1.1 | 0.59 | 15 | 27 | ○ | ○ | 780 | 44.0 | 24.0 | 13.2 |
| Ex 1-14 | — | 1.82 | 0.55 | 37 | 15 | ○ | ○ | 757 | 43.4 | 24.3 | 9.6 |
| Ex 1-15 | 2.50 | 0.50 | 0.71 | 42 | 19 | ○ | ○ | 823 | 43.0 | 23.0 | 10.5 |
| Ex 1-16 | 3.11 | — | 0.69 | 47 | 35 | ○ | ○ | 815 | 42.9 | 22.6 | 12.3 |
| Ex 1-17 | 1.50 | 1.50 | 0.82 | 38 | 15 | ○ | ○ | 850 | 42.7 | 22.0 | 11.3 |
| Ex 1-18 | 3.75 | — | 0.91 | 36 | 32 | ○ | ○ | 635 | 42.9 | 22.2 | 14.6 |
| Ex 1-19 | 3.20 | 1.80 | 1.2 | 25 | 23 | ○ | ○ | 849 | 41.0 | 20.0 | 12.1 |

(Notes in the tables)

*1"Ex" means Example according to the present invention, and "C Ex" means Comparative Example.

*2"Area" means the area ratio of crystal orientation.

*3"Cube" means cube orientation.

*4"S" means S orientation.

*5"Bending property" is in terms of occurrence of cracks ("poor" indicated with the mark "x") or not observed with any crack ("good" indicated with the mark "○").

*6"GS" means GS of cube grains.

The same as above are applied hereinafter in each table.

TABLE 2

| Identification number*1 | Alloy elements Ni mass % | Co mass % | Si mass % | Area*2 % cube*3 % | S*4 % | Bending property*5 GW | BW | YS MPa | EC % IACS | SR % | GS*6 μm |
|---|---|---|---|---|---|---|---|---|---|---|---|
| C Ex 1-1 | 0.22 | 0.23 | 0.65 | 32 | 24 | ○ | ○ | 547 | 28.8 | 22.2 | 12.5 |
| C Ex 1-2 | 3.82 | 1.44 | 0.95 | 24 | 25 | ○ | ○ | 720 | 25.8 | 26.0 | 13.3 |
| C Ex 1-3 | — | 1.12 | 0.18 | 15 | 43 | ○ | ○ | 546 | 38.2 | 35.1 | 14.2 |
| C Ex 1-4 | 2.82 | — | 1.72 | 18 | 18 | ○ | ○ | 723 | 18.3 | 24.0 | 11.3 |
| C Ex 1-5 | 1.50 | 2.50 | 0.9 | 2 | 55 | x | x | 780 | 46.5 | 23.0 | 14.6 |
| C Ex 1-6 | 1.50 | 1.20 | 1.6 | 1 | 62 | x | x | 830 | 44.5 | 29.0 | 13.2 |
| C Ex 1-7 | — | 1.02 | 0.35 | 62 | 25 | ○ | ○ | 581 | 55.7 | 25.3 | 9.6 |
| C Ex 1-8 | 2.50 | — | 0.59 | 54 | 13 | ○ | ○ | 585 | 45.2 | 25.3 | 10.5 |

As shown in Table 1, Examples 1-1 to 1-19 according to the present invention were excellent in the bending property, the proof stress, the electrical conductivity, and the stress relaxation resistance. However, as shown in Table 2, when the requirements of the present invention were not satisfied, results were poor in any of the properties. That is, since Comparative Example 1-1 had a small total amount of Ni and Co, the density of the precipitates that contributes to precipitation hardening was decreased, and the strength was not good. Furthermore, Si that did not form a compound with Ni or Co, formed a solid solution in the metal texture excessively, and thus the electrical conductivity was not good. Comparative Example 1-2 had a large total amount of Ni and Co, and thus the electrical conductivity was poor. Comparative Example 1-3 had insufficient Si, and thus the strength was poor. Comparative Example 1-4 had excessive Si, and thus the electrical conductivity was poor. Comparative Examples 1-5 and 1-6 had small ratios of the cube orientation, and thus the bending property was poor. Comparative Examples 1-7 and 1-8 had high ratios of the cube orientation, and thus the working ratio at the rolling after recrystallization was low, and thus the strength being poor.

Example 2

With respect to the respective copper alloy having the composition shown in the column of alloy elements in Table 3, with the balance of Cu and unavoidable impurities, test specimens of copper alloy sheet materials of Examples 2-1 to 2-17 according to the present invention and Comparative Example 2-1 to 2-3 were produced in the same manner as in Example 1, and the test specimens were subjected to examination of the properties in the same manner as in Example 1. The results are shown in Table 3.

TABLE 3

| Identification number*1 | Alloy elements Ni mass % | Co mass % | Si mass % | Other elements mass % | Area*2 % cube*3 % | S*4 % | Bending property*5 GW | BW | YS MPa | EC % IACS | SR % | GS*6 μm |
|---|---|---|---|---|---|---|---|---|---|---|---|---|
| Ex 2-1 | 0.50 | 1.00 | 0.36 | 0.15Sn, 0.2Ag | 42 | 14 | ○ | ○ | 655 | 53.9 | 23.1 | 8.9 |
| Ex 2-2 | 1.00 | 0.50 | 0.38 | 0.03Zr, 0.05Mn | 36 | 34 | ○ | ○ | 716 | 50.7 | 20.5 | 8.4 |
| Ex 2-3 | — | 0.80 | 0.45 | 0.32Ti, 0.21Fe | 24 | 22 | ○ | ○ | 691 | 52.2 | 21.6 | 7.3 |
| Ex 2-4 | 0.50 | 1.50 | 0.35 | 0.2Ag, 0.05B, 0.1Mg | 9 | 9 | ○ | ○ | 718 | 51.7 | 23.2 | 7.7 |
| Ex 2-5 | 0.80 | 1.20 | 0.42 | 0.14Mg, 0.15Sn, 0.3Zn | 35 | 33 | ○ | ○ | 714 | 50.4 | 19.4 | 8.1 |
| Ex 2-6 | 1.00 | 1.00 | 0.48 | 0.23Cr, 0.14Mg, 0.10P | 23 | 21 | ○ | ○ | 738 | 49.0 | 21.6 | 8.7 |
| Ex 2-7 | 2.32 | — | 0.65 | 0.2Hf, 0.2Zn | 45 | 42 | ○ | ○ | 707 | 40.2 | 24.2 | 10.8 |
| Ex 2-8 | 0.90 | 1.70 | 0.61 | 0.04Zr, 0.42Ti, 0.11Mg | 33 | 31 | ○ | ○ | 836 | 45.9 | 21.0 | 11.3 |
| Ex 2-9 | 1.10 | 1.50 | 0.55 | 0.15Sn, 0.2Ag | 11 | 11 | ○ | ○ | 834 | 44.9 | 22.4 | 9.1 |
| Ex 2-10 | — | 1.38 | 0.38 | 0.11Mg, 0.32Zn | 17 | 16 | ○ | ○ | 793 | 44.4 | 23.0 | 8.0 |
| Ex 2-11 | 1.35 | 1.15 | 0.61 | 0.14Mg, 0.15Sn, 0.3Zn | 21 | 19 | ○ | ○ | 736 | 52.4 | 21.3 | 11.6 |
| Ex 2-12 | 1.35 | 1.15 | 0.61 | 0.22Cr, 0.05Mn | 13 | 12 | ○ | ○ | 871 | 42.1 | 22.3 | 10.3 |
| Ex 2-13 | 1.5 | 1.1 | 0.59 | 0.11Mg, 0.32Zn, 0.5Ti | 14 | 13 | ○ | ○ | 783 | 43.7 | 22.0 | 12.4 |
| Ex 2-14 | — | 1.82 | 0.55 | 0.14Mg, 0.15Sn, 0.3Zn | 35 | 33 | ○ | ○ | 763 | 42.8 | 20.3 | 9.0 |
| Ex 2-15 | 2.50 | 0.50 | 0.71 | 0.23Cr, 0.11Mg, 0.32Zn | 39 | 37 | ○ | ○ | 832 | 42.1 | 20.0 | 9.9 |
| Ex 2-16 | 3.11 | — | 0.69 | 0.20Cr, 0.2Sn, 0.2Ag | 44 | 42 | ○ | ○ | 821 | 42.6 | 18.6 | 11.6 |
| Ex 2-17 | 1.50 | 1.50 | 0.82 | 0.04Mn, 0.2Fe, 0.1Hf | 36 | 34 | ○ | ○ | 859 | 42.1 | 19.0 | 10.6 |
| C Ex 2-1 | 2.32 | — | 0.65 | 0.62Hf, 0.55Zn | 45 | 42 | ○ | ○ | 707 | 28.2 | 24.2 | 10.8 |
| C Ex 2-2 | 1.35 | 1.15 | 0.61 | 0.42Mg, 0.82Sn, 0.53Zn | 21 | 19 | ○ | ○ | 736 | 27.2 | 21.3 | 11.6 |
| C Ex 2-3 | — | 1.82 | 0.55 | 0.61Mn, 0.32Cr, 0.42Ag | 35 | 33 | ○ | ○ | 763 | 25.2 | 20.3 | 9.0 |

As shown in Table 3, Examples 2-1 to 2-17 according to the present invention were excellent in the bending property, the proof stress, the electrical conductivity, and the stress relaxation resistance. However, when the requirements of the present invention were not satisfied, any of the properties was poor. That is, since Comparative Examples 2-1, 2-2, and 2-3 had excessive contents of other elements, the electrical conductivity thereof was poor.

Test specimens of copper alloy sheet material of Examples 3-1 to 3-12 according to the present invention and Comparative Examples 3-1 to 3-10 were produced in the same manner as in Example 1, except that the copper alloy having the same composition as Example 2-11 according to the present invention in Table 3 was produced under the conditions, as shown in Table 4, of the temperature and time period of the heat treatment [step 7], the working ratio of the cold rolling [step 8], and the respective working ratios R1 and R2 of the cold rolling [step 10] and the finish cold rolling [step 12], and the resultant test specimens were subjected to examination of the properties in the same manner as in Example 1. The results are shown in Table 4. In the Table 4, for example, the term "[step 8]" is indicated simply as "[8]", and the term "finish cold rolling [step 12]" is indicated as "cold rolling [12]".

TABLE 4

| Identification number*1 | Heat treatment[7] Temp. °C. | Time | Cold rolling[8] Working ratio % | Cold rolling[10] Working ratio R1 % | Cold rolling[12] Working ratio R2 % | Area*2 % cube*3 % | S*4 % | Bending property*5 GW | BW | YS MPa | EC % IACS | SR % | GS*6 μm |
|---|---|---|---|---|---|---|---|---|---|---|---|---|---|
| Ex 3-1 | 400 | 10 hr | 20 | 25 | 10 | 25 | 29 | ○ | ○ | 708 | 48.0 | 21.2 | 8.7 |
| Ex 3-2 | 500 | 2 hr | 15 | 20 | 7 | 50 | 33 | ○ | ○ | 679 | 39.4 | 23.7 | 10.7 |
| Ex 3-3 | 600 | 10 min | 30 | 35 | 3 | 36 | 35 | ○ | ○ | 803 | 45.0 | 20.6 | 11.2 |
| Ex 3-4 | 700 | 1 min | 5 | 20 | 8 | 12 | 14 | ○ | ○ | 801 | 44.0 | 22.0 | 9.0 |
| Ex 3-5 | 750 | 30 sec | 15 | 15 | 14 | 19 | 20 | ○ | ○ | 761 | 43.5 | 22.5 | 7.9 |
| Ex 3-6 | 800 | 5 sec | 20 | 30 | 20 | 23 | 25 | ○ | ○ | 707 | 51.4 | 20.9 | 11.4 |
| Ex 3-7 | 700 | 1 min | 45 | 20 | 13 | 14 | 16 | ○ | ○ | 836 | 41.3 | 21.9 | 10.2 |
| Ex 3-8 | 600 | 1 hr | 20 | 20 | 9 | 16 | 17 | ○ | ○ | 752 | 42.8 | 21.6 | 12.3 |
| Ex 3-9 | 500 | 1 hr | 15 | 15 | 13 | 38 | 26 | ○ | ○ | 732 | 41.9 | 19.9 | 8.9 |
| Ex 3-10 | 550 | 2 hr | 10 | 20 | 13 | 43 | 25 | ○ | ○ | 799 | 41.3 | 19.6 | 9.8 |
| Ex 3-11 | 700 | 1 min | 15 | 15 | 5 | 49 | 38 | ○ | ○ | 788 | 41.7 | 18.2 | 11.4 |
| Ex 3-12 | 500 | 1 hr | 5 | 25 | 15 | 39 | 25 | ○ | ○ | 825 | 41.3 | 18.6 | 10.5 |
| C Ex 3-1 | 350 | 2 hr | 20 | 30 | 15 | 2 | 42 | x | x | 762 | 45.2 | 24.2 | 10.8 |
| C Ex 3-2 | 850 | 1 min | 15 | 30 | 15 | 1 | 19 | x | x | 736 | 43.2 | 21.3 | 11.6 |
| C Ex 3-3 | N/A | | 10 | 30 | 10 | 2 | 35 | x | x | 836 | 41.3 | 22.5 | 11.6 |
| C Ex 3-4 | 650 | 25 hr | 15 | 25 | 10 | 1 | 30 | x | x | 799 | 44.0 | 20.9 | 11.6 |
| C Ex 3-5 | 500 | 2 hr | N/A | 25 | 10 | 2 | 42 | x | x | 801 | 44.0 | 22.0 | 9.0 |
| C Ex 3-6 | 600 | 10 min | 65 | 30 | 15 | 1 | 50 | x | x | 752 | 42.8 | 21.6 | 12.3 |
| C Ex 3-7 | 500 | 2 hr | 20 | N/A | N/A | 65 | 15 | ○ | ○ | 582 | 41.9 | 20.3 | 9.0 |
| C Ex 3-8 | 600 | 10 min | 20 | 3 | N/A | 55 | 22 | ○ | ○ | 588 | 44.0 | 19.6 | 9.8 |
| C Ex 3-9 | 700 | 1 min | 15 | 40 | 30 | 3 | 35 | x | x | 821 | 41.3 | 18.2 | 11.4 |
| C Ex 3-10 | 750 | 30 sec | 10 | 25 | 50 | 3 | 42 | x | x | 840 | 45.2 | 18.6 | 10.5 |

As shown in Table 4, Examples 3-1 to 3-12 according to the present invention were excellent in the bending property, the proof stress, the electrical conductivity, and the stress relaxation resistance. However, when the requirements of the present invention were not satisfied, any of the properties was poor. That is, Comparative Example 3-1 was produced at a too low temperature of the heat treatment [step 7], Comparative Example 3-2 was produced at a too high temperature of the heat treatment [step 7], Comparative Example 3-3 was produced without performing the heat treatment [step 7], and Comparative Example 3-4 was produced with a too long time period for the heat treatment [step 7], and thus the area ratio of the cube orientation thereof was lowered, resulting in a poor bending property. Comparative Example 3-5 was produced without performing the cold rolling [step 8], and Comparative Example 3-6 was produced at a too high working ratio of the cold rolling [step 8], and the area ratio of the cube orientation thereof was lowered, resulting in a poor bending property. Comparative Examples 3-7 and 3-8 each had a smaller sum of the working ratios of R1 and R2, and thus the strength was poor. Comparative Examples 3-9 and 3-10 each had a larger sum of the working ratios R1 and R2, and thus the area ratio of the cube orientation was lowered, resulting in a poor bending property.

Example 4

This is to show examples, with the copper alloy having the same composition as that of Example 2-13 according to the present invention, as shown in Table 3, in which the aging precipitation heat treatment [step 11] was the final step. Test specimens of copper alloy sheet materials of Examples 4-1 and 4-2 according to the present invention were produced in the same manner as in Example 1, except that the production was carried out under the conditions, as indicated in Table 5, of the temperature and time period of the heat treatment [step 7], the working ratio of the cold rolling [step 8], and the working ratio R1 of the cold rolling [step 10], and the resultant test specimens were subjected to examination of the properties in the same manner as in Example 1. The results are shown in Table 5. In the Table 5, for example, the term "[step 8]" is indicated simply as "[8]", and the term "finish cold rolling [step 12]" is indicated as "cold rolling [12]".

Example 5

This is to show examples, with the copper alloy having the same composition as that of Example 2-13 according to the present invention, as shown in Table 3, in which the aging precipitation heat treatment [step 11] was the subsequent step of the intermediate solution heat treatment [step 9]. Test specimens of copper alloy sheet materials of Examples 5-1 and 5-2 according to the present invention were produced in the same manner as in Example 1, except that the production was carried out under the conditions, as indicated in Table 5, of the temperature and time period of the heat treatment [step 7], the working ratio of the cold rolling [step 8], and the working ratio R2 of the finish cold rolling [step 12], and the resultant test specimens were subjected to examination of the properties in the same manner as in Example 1. The results are shown in Table 5.

Example 6

This is to show examples, with the copper alloy having the same composition as that of Example 2-11 according to the present invention, as shown in Table 3, in which the face milling [step 5] was the subsequent step of the hot working [step 3]. Test specimens of copper alloy sheet materials of Examples 6-1 and 6-2 according to the present invention were produced in the same manner as in Example 1, except that the production was carried out under the conditions, as indicated in Table 5, of the temperature and time period of the heat treatment [step 7], the working ratio of the cold rolling [step 8], and the respective working ratios R1 and R2 of the cold rolling [step 10] and the finish cold rolling [step 12], and the resultant test specimens were subjected to examination of the properties in the same manner as in Example 1. The results are shown in Table 5. Furthermore, in Example 6, the temperature at the time of completion of the hot working [step 3] was all set at 500° C.

Example 7

This is to show examples, with the copper alloy having the same composition as that of Example 2-11 according to the present invention, as shown in Table 3, in which the hot working [step 3] was the subsequent step of the casting [step 1]. Test specimens of copper alloy sheet materials of Examples 7-1 and 7-2 according to the present invention were produced in the same manner as in Example 1, except that the production was carried out under the conditions, as indicated in Table 5, of the temperature and time period of the heat treatment [step 7], the working ratio of the cold rolling [step 8], and the respective working ratios R1 and R2 of the cold rolling [step 10] and the finish cold rolling [step 12], and the resultant test specimens were subjected to examination of the properties in the same manner as in Example 1. The results are shown in Table 5. Furthermore, in Example 7, the segregation state of the ingot obtained after the casting [step 1] was checked, and samples having negligible segregation were used. The temperature at the time of initiation of the hot working [step 3] was set at 900° C. in the same manner as in Example 1, and the hot working was initiated immediately after the temperature of the ingot was raised to 900° C. by heating.

TABLE 5

| Identification number*1 | Omitted step(s) | Step[7] Temp. ° C. | Step[7] Time | Step[8] Working ratio % | Step[10] Working ratio R1 % | Step[12] Working ratio R2 % | Area *2 Cube*3 % | Area *2 S*4 % | Bending property GW | Bending property BW | YS MPa | EC % IACS | SR % | GS*6 μm |
|---|---|---|---|---|---|---|---|---|---|---|---|---|---|---|
| Ex 4-1 | [12], [13] | 550 | 1 hr | 30 | 15 | N/A | 27 | 30 | ○ | ○ | 722 | 44.5 | 21.3 | 11.5 |
| Ex 4-2 | [12], [13] | 600 | 15 min | 22 | 20 | N/A | 32 | 30 | ○ | ○ | 702 | 42.2 | 22.4 | 12.6 |
| Ex 5-1 | [10] | 650 | 1 min | 23 | N/A | 12 | 22 | 32 | ○ | ○ | 734 | 43.7 | 22.6 | 13.2 |
| Ex 5-2 | [10] | 700 | 1 min | 15 | N/A | 15 | 23 | 35 | ○ | ○ | 721 | 41.6 | 22.0 | 10.6 |
| Ex 6-1 | [4] | 550 | 15 min | 30 | 22 | 7 | 25 | 33 | ○ | ○ | 735 | 44.2 | 20.2 | 13.0 |
| Ex 6-2 | [4] | 650 | 15 min | 15 | 24 | 10 | 33 | 34 | ○ | ○ | 752 | 41.4 | 21.5 | 14.5 |

TABLE 5-continued

| Identification number*1 | Omitted step(s) | Step[7] Temp. ° C. | Step[7] Time | Step[8] Working ratio % | Step[10] Working ratio R1 % | Step[12] Working ratio R2 % | Area *2 Cube*3 % | Area *2 S*4 % | Bending property GW | Bending property BW | YS MPa | EC % IACS | SR % | GS*6 μm |
|---|---|---|---|---|---|---|---|---|---|---|---|---|---|---|
| Ex 7-1 | [2] | 600 | 1 hr | 17 | 18 | 22 | 19 | 25 | ○ | ○ | 725 | 42.7 | 20.8 | 13.2 |
| Ex 7-2 | [2] | 600 | 15 min | 15 | 22 | 25 | 17 | 18 | ○ | ○ | 780 | 41.1 | 21.3 | 11.9 |

As shown in Table 5, Examples 4-1 and 4-2, and Examples 5-1 and 5-2 according to the present invention each exhibited a tendency that the proof stress was lowered as compared with Example 2-13 according to the present invention, but each had sufficient properties required of copper alloy sheet materials for electrical or electronic parts. Furthermore, Examples 6-1 and 6-2, and Examples 7-1 and 7-2 according to the present invention each exhibited properties that were substantially equal to those of Example 2-11 according to the present invention.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-145707 filed in Japan on Jun. 3, 2008, each of which is entirely herein incorporated by reference.

The invention claimed is:

1. A copper alloy sheet material, having a composition comprising any one or both of Ni and Co in an amount of 0.5 to 5.0 mass % in total, and Si in an amount of 0.3 to 1.5 mass %, with the balance of copper and unavoidable impurities, wherein an area ratio of cube orientation {0 0 1} <1 0 0> is 5 to 50%, and an area ratio of S orientation {2 3 1} <3 4 6> is 5 to 40%, according to a crystal orientation analysis in EBSD measurement.

2. The copper alloy sheet material according to claim 1, wherein an average grain size of grains of cube orientation {0 0 1} <1 0 0> is 20 μm or less.

3. The copper alloy sheet material according to claim 1, wherein the copper alloy contains at least one selected from the group consisting of Sn, Zn, Ag, Mn, B, P, Mg, Cr, Fe, Ti, Zr, and Hf, in an amount of 0.005 to 1.0 mass % in total.

4. The copper alloy sheet material according to claim 3, wherein an average grain size of grains of cube orientation {0 0 1} <1 0 0> is 20 μm or less.

5. A method of producing a copper alloy sheet material according to claim 1, comprising the steps of treatments and workings of a copper alloy material that serves as a raw material for the copper alloy sheet material: casting [step 1], homogenization heat treatment [step 2], hot working [step 3], water cooling [step 4], face milling [step 5], cold rolling [step 6], heat treatment [step 7], cold rolling [step 8], intermediate solution heat treatment [step 9], cold rolling [step 10], aging precipitation heat treatment [step 11], finish cold rolling [step 12], and temper annealing [step 13], in this sequence, wherein the heat treatment [step 7] is conducted at a temperature of 400 to 800° C. for a time period of 5 seconds to 20 hours, wherein the cold rolling [step 8] is conducted at a working ratio of 50% or less, and wherein the sum of a working ratio R1(%) in the cold rolling [step 10] and a working ratio R2(%) in the finish cold rolling [step 12] is 5 to 65%.

6. The method of producing a copper alloy sheet material according to claim 5, wherein the aging precipitation heat treatment [step 11] is carried out as the final step, wherein the heat treatment [step 7] is conducted at the temperature of 400 to 800° C. for the time period of 5 seconds to 20 hours, wherein the cold rolling [step 8] is conducted at the working ratio of 50% or less, and wherein the working ratio R1(%) in the cold rolling [step 10] is 5 to 65%.

7. The method of producing a copper alloy sheet material according to claim 5, wherein the aging precipitation heat treatment [step 11] is carried out as a subsequent step of the intermediate solution heat treatment [step 9], wherein the heat treatment [step 7] is conducted at the temperature of 400 to 800° C. for the time period of 5 seconds to 20 hours, wherein the cold rolling [step 8] is conducted at the working ratio of 50% or less, and wherein the working ratio R2(%) in the finish cold rolling [step 12] is 5 to 65%.

8. The method of producing a copper alloy sheet material according to claim 5, wherein the face milling [step 5] is carried out as a subsequent step of the hot working [step 3], wherein the heat treatment [step 7] is conducted at the temperature of 400 to 800° C. for the time period of 5 seconds to 20 hours, wherein the cold rolling [step 8] is conducted at the working ratio of 50% or less, and wherein the sum of the working ratio R1(%) in the cold rolling [step 10] and the working ratio R2(%) in the finish cold rolling [step 12] is 5 to 65%.

9. The method of producing a copper alloy sheet material according to claim 5, wherein the hot working [step 3] is carried out as a subsequent step of the casting [step 1], wherein the heat treatment [step 7] is conducted at the temperature of 400 to 800° C. for the time period of 5 seconds to 20 hours, wherein the cold rolling [step 8] is conducted at the working ratio of 50% or less, and wherein the sum of the working ratio R1(%) in the cold rolling [step 10] and the working ratio R2(%) in the finish cold rolling [step 12] is 5 to 65%.

* * * * *